US007857710B2

(12) United States Patent
Pedraza

(10) Patent No.: US 7,857,710 B2
(45) Date of Patent: Dec. 28, 2010

(54) GOLF CLUB

(75) Inventor: Luis Pedraza, West Roxbury, MA (US)

(73) Assignee: AXIS1, LLC, West Roxbury, MA (US)

( * ) Notice: Subject to any disclaimer, the term of this patent is extended or adjusted under 35 U.S.C. 154(b) by 213 days.

(21) Appl. No.: 12/250,676

(22) Filed: Oct. 14, 2008

(65) Prior Publication Data

US 2009/0042666 A1 Feb. 12, 2009

Related U.S. Application Data

(63) Continuation-in-part of application No. 12/166,050, filed on Jul. 1, 2008, now Pat. No. 7,722,476, which is a continuation of application No. 11/149,874, filed on Jun. 10, 2005, now Pat. No. 7,407,445.

(51) Int. Cl.
*A63B 53/02* (2006.01)
*A63B 53/04* (2006.01)

(52) U.S. Cl. ..... 473/313; 473/314; 473/316; 473/340

(58) Field of Classification Search ..... 473/313–314, 473/340–342, 349
See application file for complete search history.

(56) References Cited

U.S. PATENT DOCUMENTS

| | | | |
|---|---|---|---|
| 2,926,913 | A | 3/1960 | Stecher |
| 3,194,564 | A | 7/1965 | Swan |
| 3,967,826 | A | 7/1976 | Judice |
| 4,063,733 | A | 12/1977 | Benedict |
| 4,265,452 | A | 5/1981 | Vella |
| 4,290,606 | A | 9/1981 | Maxwell |
| 4,383,690 | A | 5/1983 | Maxwell |
| 4,650,191 | A | 3/1987 | Mills |
| 4,846,477 | A | 7/1989 | Phelan |
| 4,852,879 | A | 8/1989 | Collins |
| 4,988,107 | A | 1/1991 | Sasse |
| D317,807 | S | 6/1991 | Adams |
| 5,183,255 | A | 2/1993 | Antonious |

(Continued)

OTHER PUBLICATIONS

International Search Report and Written Opinion of the International Searching Authority for International Application No. PCT/US2009/060420, mailed Dec. 3, 2009, 8 pages.

*Primary Examiner*—Stephen L. Blau
(74) *Attorney, Agent, or Firm*—Gallagher & Dawsey Co., LPA; Michael J. Gallagher; David J. Dawsey

(57) ABSTRACT

A golf club having a shaft, a grip, and a head provides improved balance and feel. The shaft has a shaft distal end, a shaft axis defining a vertical plane, and a forward bend section proximate the shaft distal end. The head is secured to the shaft distal end and includes a striking face, a trailing edge, a club head center of gravity, a heel section having a heel section center of gravity, and a toe section having a toe section center of gravity. The heel section center of gravity is forward of the striking face and the club head center of gravity is further from the trailing edge than the striking face. The forward bend section of the shaft projects from the vertical plane at an attachment angle such that the shaft distal end is forward of the heel section center of gravity.

19 Claims, 16 Drawing Sheets

U.S. PATENT DOCUMENTS

| | | | |
|---|---|---|---|
| 5,441,268 | A | 8/1995 | Shier |
| 5,544,883 | A | 8/1996 | Meyer |
| 5,620,379 | A | 4/1997 | Borys |
| 6,017,281 | A | 1/2000 | Behling |
| 6,350,208 | B1 | 2/2002 | Ford |
| D458,658 | S | 6/2002 | Jung |
| 6,514,155 | B1 | 2/2003 | Sheets |
| RE38,717 | E | 3/2005 | Bothwell |
| 7,101,288 | B2 | 9/2006 | Thomas |
| 7,407,455 | B2 | 8/2008 | Pedraza |
| 2003/0045369 | A1 | 3/2003 | Murray et al. |
| 2004/0029647 | A1 | 2/2004 | Bennett |
| 2004/0229711 | A1 | 11/2004 | Trumble et al. |
| 2005/0164805 | A1 | 7/2005 | Durnin |
| 2005/0215346 | A1 | 9/2005 | Iwade |
| 2005/0227778 | A1 | 10/2005 | Pollman |
| 2006/0281578 | A1 | 12/2006 | Pedraza |

GOLF CLUB

CROSS REFERENCE TO RELATED APPLICATIONS

This application is a continuation-in-part of U.S. patent application Ser. No. 12/166,050, filed on Jul. 1, 2008, now U.S. Pat. No. 7,722,476 which is a continuation of U.S. patent application Ser. No. 11/149,874, filed on Jun. 10, 2005, now U.S. Pat. No. 7,407,445, the contents of which are hereby incorporated by reference in their entirety.

TECHNICAL FIELD

This invention relates generally to golf clubs, and more particularly to golf putters.

BACKGROUND

Many golf club designs have been introduced to improve golfers' accuracy, such as adding materials to dampen the impact with the ball, aligning the shaft with the club face placing the shaft forward of the club face, aligning the shaft with the center of gravity of the club head, adding enlarged alignment features, etc.

SUMMARY

It is desirable to strike a golf ball as squarely as possible on the "sweet spot" of the club face in order to properly hit the ball. The sweet spot is the preferred striking point on the club face. If the center gravity of the head of the club is not aligned with the grip axis, there is a tendency for the club head to rotate about the grip axis. When this occurs, the player must compensate for the rotation of the club. This rotation adds an additional variable to the complex nature of the golf swing. However, by placing the center of gravity proximate to the grip axis, the rotation of the club head about the grip axis is minimized, thereby minimizing one factor from the complex nature of the golf swing. Further, it is desirable to align the grip axis proximate to the striking face of the club head or slightly ahead of the clubface (using an offset hosel) in order to strike the ball with a more natural stroke. Further, it is desirable that the club head have substantial depth to allow for alignment features.

According to one aspect of the invention, a golf club (such as a putter) includes a shaft, a grip and a head. The grip is at an upper end of the shaft and defines a grip axis inclined with respect to the vertical, the inclined grip axis defining a vertical plane, such as with the club held in its intended position to address a golf ball. The grip defines a radius about the grip axis. The head is secured to a lower end of said shaft and has a striking face and a trailing edge. Notably, the head has a gravitational center which is further from the trailing edge than the striking face and is spaced from the vertical plane a distance less than the grip radius.

In some embodiments, the center of gravity is within 0.84 inch of a striking face and in a vertical plane which includes the grip axis and yet has substantial depth of the putter to allow for alignment features. The golf club having a head with counterbalance weight forward of the striking surface positioned in such a way that the mass distribution will result in the center of gravity of the club head being aligned with the vertical plane created by the axis of the putter shaft. In some embodiments, positioning the center of gravity on the vertical plane defined by the axis of the shaft causes the club head to be balanced about the axis while addressing the ball. In other embodiments, positioning the center of gravity on the axis of the shaft causes the club head to be balanced as it is rotated about the axis of the shaft. In addition, by locating the center of gravity at the intersection of the vertical plane created by the line defining the ideal striking location and on the axis of the shaft, the golf club will be in perfect balance and not rotate in the player's hand while the player addresses or strikes a golf ball.

In some embodiments, the head is asymmetrical, such as about the vertical plane containing the inclined grip axis as the club is positioned in contact with a ball.

The preferred proximity of the gravitational center will vary with grip radius in many cases. In some embodiments, the gravitational center is spaced less than about 0.65 inch from the vertical plane. In some cases, less than 0.5 inch, or even less than 0.3 inch.

Preferably, the gravitational center is disposed substantially on the vertical plane, and even more preferably substantially on the grip axis itself.

In some constructions, the gravitational center is disposed less than the grip radius from the striking face, and may be forward of the striking face, such as less than 0.84 inch or a standard golf ball radius forward of the striking face.

In some embodiments, the gravitational center coincides with a preferred striking point of the striking face.

In many clubs the striking face is oriented to impart a force in a direction substantially normal to the vertical plane.

In some constructions the head is formed using of a single material, and may include an alignment aid on the trailing edge. In some other cases the head is formed from a plurality of materials of different densities, and may have removable heel and toe counterweights. In some instances the club is provided in combination with replacement heel and toe counterweights of different weights, such that the user may adjust the weight or weight distribution of the head.

According to another aspect of the invention, a golf club includes a shaft having a grip region at an upper end, and a head. The grip region defines a grip axis. The head is secured to a lower end of said shaft and has a forward face and a trailing edge. Notably, the head has a gravitational center which is disposed further from the trailing edge than the striking face and substantially on the grip axis.

Various embodiments of this aspect of the invention feature various characteristics described above. In some cases the gravitational center is disposed substantially at a point defined by the grip axis and a sweet spot on the forward face of the head.

According to yet another aspect of the invention, a golf club has a shaft, a grip and a head. The grip is disposed at an upper end of the shaft, and defines a grip axis inclined with respect to the vertical, such that the inclined grip axis defines a vertical plane as the putter is held so as to address a golf ball. The grip defines a radius about the grip axis. A plurality of parts are assembled to form the head, secured to a lower end of said shaft, the head having a striking face and a trailing edge. Notably, the head has a gravitational center which is further from the trailing edge than the striking face, and is spaced from the vertical plane a distance less than the grip radius.

Various embodiments of this aspect of the invention feature various characteristics described above. In some cases the gravitational center is disposed substantially on the grip axis.

Other aspects of the invention feature methods of making the golf club disclosed herein, and methods of using such a club to strike a golf ball.

The details of one or more embodiments of the invention are set forth in the accompanying drawings and the description below. Other features, objects, and advantages of the invention will be apparent from the description and drawings, and from the claims.

DESCRIPTION OF DRAWINGS

Without limiting the scope of the present invention as claimed below and referring now to the drawings and figures:

Figure 1:
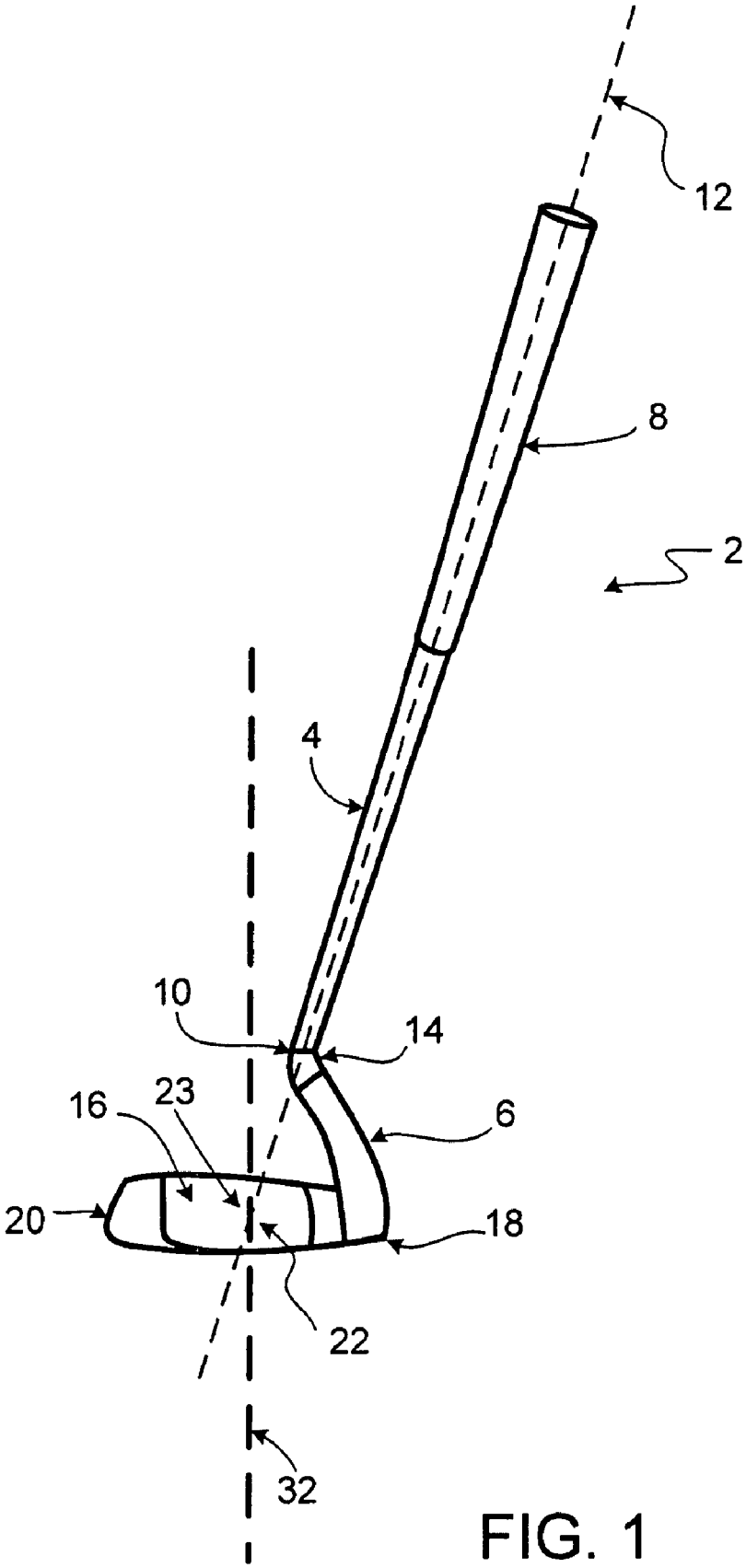
FIG. 1 is one embodiment of a golf club, not to scale.

Like reference symbols in the various drawings indicate like elements. These drawings are provided to assist in the understanding of the exemplary embodiments of the invention as described in more detail below and should not be construed as unduly limiting the invention. In particular, the relative spacing, positioning, sizing and dimensions of the various elements illustrated in the drawings are not drawn to scale and may have been exaggerated, reduced or otherwise modified for the purpose of improved clarity. Those of ordinary skill in the art will also appreciate that a range of alternative configurations have been omitted simply to improve the clarity and reduce the number of drawings.

DETAILED DESCRIPTION

FIG. 1 is one embodiment of a golf club (2). The golf club (2) consists of two major components the shaft (4) and a head (6). The golf club (2) is assembled in a manner customary to the industry.

The shaft (4) consists of a grip region (8) and a lower end (10). The grip region (8) is conformed to be held by a person. The grip region (8) defines an axis (12) which intersects the center of gravity (22) of the head (6). The grip region (8) may be fitted with the material selected for comfort and control. The lower end (10) is secured to the hosel (14) of the head (6). In the present embodiment, the shaft (4) intersects the center of gravity of the head (6). Typically, the axis (12) is inclined with respect to a vertical axis (32). In other words, it is typically not perpendicular to a horizontal surface. The incline of axis (12) defines a vertical plane. In some embodiments the head (6) may be asymmetrical with respect to the vertical plane.

The head (6) consists of a hosel (14), a striking face (16), and a trailing edge (not shown in this view.) In the embodiment shown, the hosel (14) is attached to the heel (18) of the head (6). The striking face (16) is located between the heel (18) and the toe (20). The mass of the head (6) is distributed such that the center of gravity (22) of the head (6) is located proximate to the center of the striking face (16) and on axis (12). In some embodiments, the mass of the head (6) is distributed such that the center of gravity (22) is located slightly in front or on the striking face (16). In other embodiments, the mass of the head (6) is distributed such that the center of gravity (22) may be located slightly behind the striking face (16). The striking face (16) may have either a positive or negative inclination. By distributing the mass of head (6) such that the center of gravity (22) lies on axis (12), the club is less likely to twist while a user addresses the ball. In this embodiment, the sweet spot (23) on striking face (16) is located proximate to the center of gravity (22) and does not coincide with the center of gravity (22). However, in other embodiments, wherein the center of gravity (22) lies on striking face (16), the sweet spot (23) may be located at the same point as the center of gravity. The sweet spot (23) may be defined as the location on the striking face (16) that is substantially inline with a substantially perpendicular line extending horizontally from the club head center of gravity (22) to the striking face (16). In some embodiments, the center of gravity (22) is located proximate to the vertical plane. In some embodiments, the center of gravity (22) is located proximate to the axis (12). In other embodiments, the center of gravity (22) is located proximate to the axis (12) and the striking face of head (6).

Figure 2:
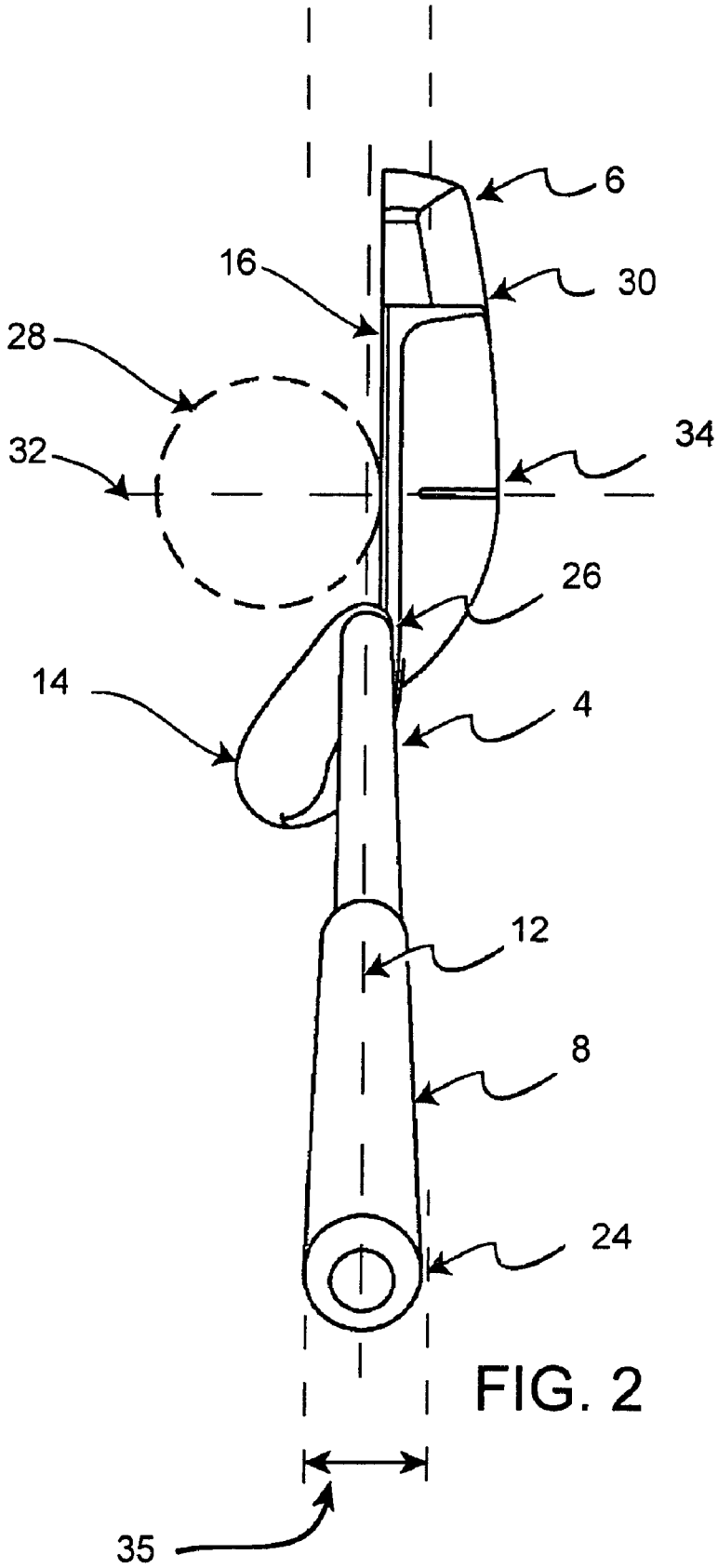
FIG. 2 is a top view the golf club of FIG. 1 in relationship to a golf ball, not to scale.

FIG. 2 is a top view the embodiment of FIG. 1 in relationship to a golf ball (28). The shaft (4) consists of the grip region (8) at the upper end (24) and a lower end (26). The grip region (8) defines the axis (12), which as shown in this view is located upper to and front of striking face (16). The lower end (26) of shaft (4) is secured to the hosel (14) of the head (6).

The head (6) consists of the hosel (14), the front face (16), the trailing edge (30), the heel (18), and the toe (20). The striking face (16) is designed to impart a momentum in a vertical plane that includes vertical axis (32). Vertical axis (32) is defined as a horizontal line intersecting sweet spot (23) and axis (12). The momentum imparted to golf ball (28) may be either positively inclined to vertical axis (32), negatively inclined to vertical axis (32) or on vertical axis (32). The trailing edge (30) may further include an alignment aid (34). This embodiment features a substantial alignment aid (34) while maintaining the center of gravity proximate the striking face (16). The alignment aid (34) is designed to assist the user, while the user addresses a golf ball (28). Clubs without enlarged trailing edges tend to have short sight lines which would inhibit a golfer's ability to line up the club, the ball and the hole.

Figure 2A:
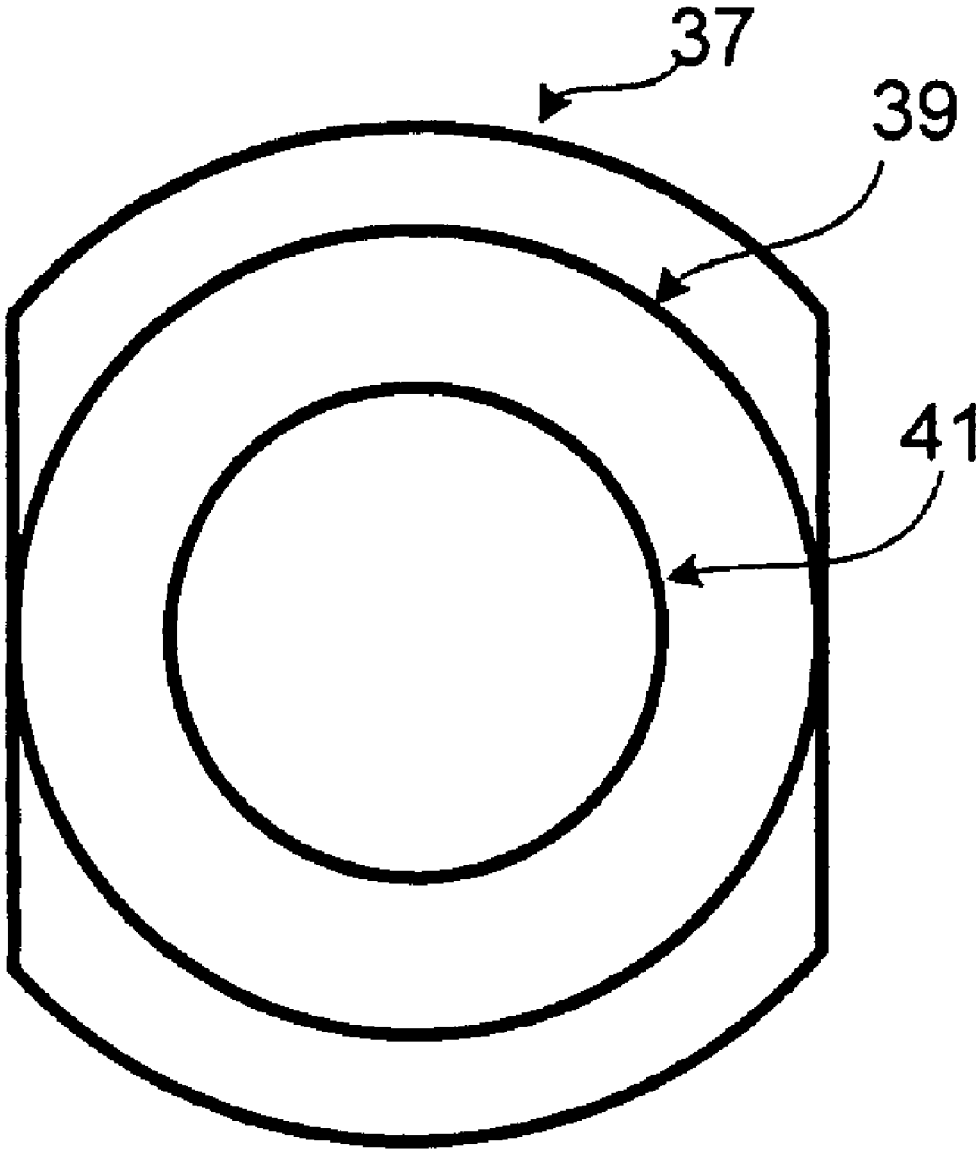
FIG. 2A is a top view of the golf club shaft of FIG. 1, not to scale.

Turning to FIG. 2A, in the embodiment shown, the shaft diameter measures 0.6 inch across. The grip region (8) diameter (35) may vary. However, in some embodiments, the grip region (8) is 1.0 inch across the narrow side and 1.3 inches across the widest part.

Figure 3A:
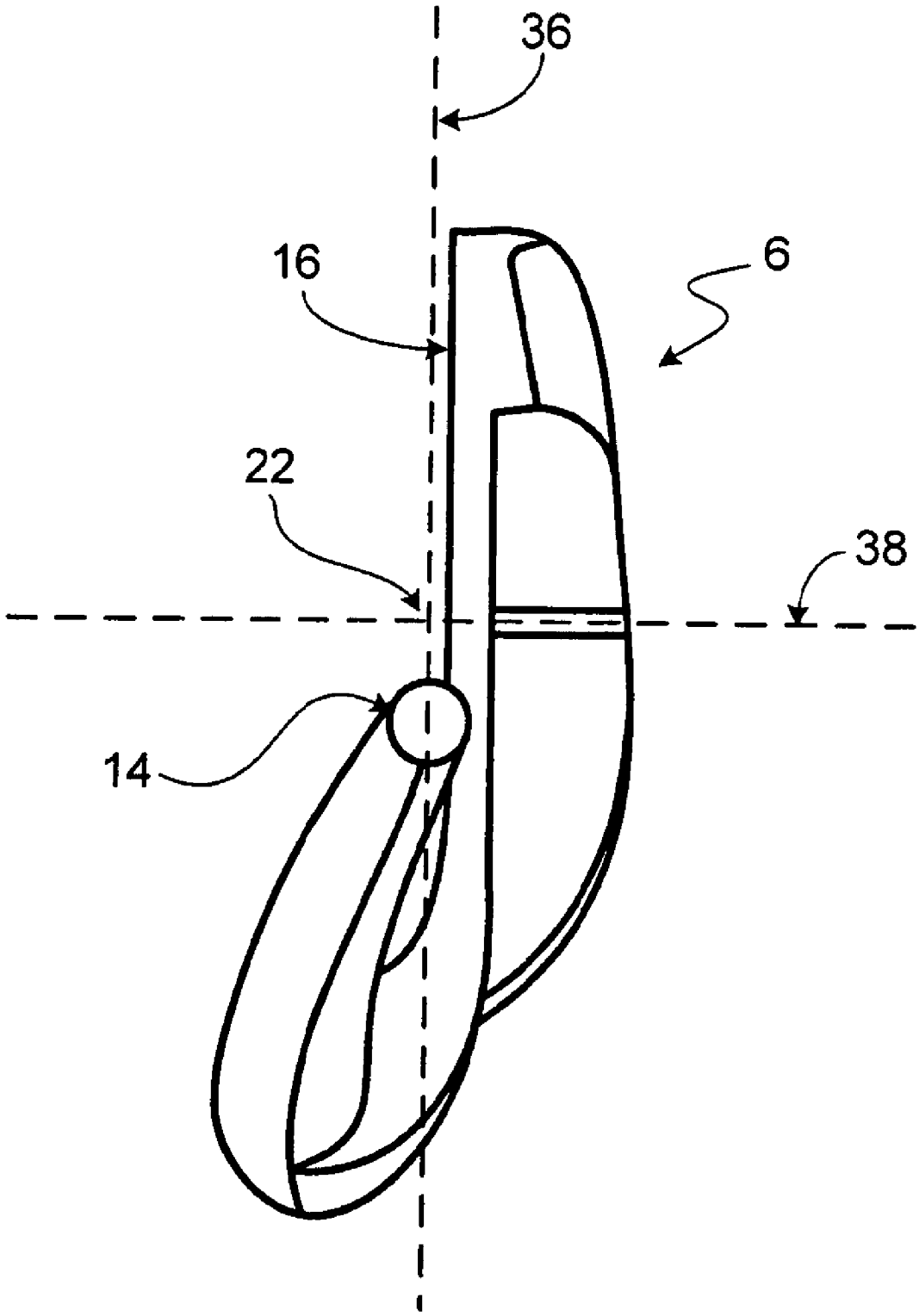
FIG. 3A is a top view of the golf club head of FIG. 1, not to scale.

FIG. 3A is a top view of the head (6) without the shaft. The head (6) is shown in relationship to plane A (36) and plane B (38). The center of gravity (22) of the head (6) lies proximate to the sweet spot (23) on striking face (16) and the intersection of plane A (36) and plane B (38). Vertical axis (32) (not shown in this view) is a horizontal line that lies in plane B (38) and intersects the sweet spot (23). In this embodiment, the head (6) is constructed from a single material and the proper mass distribution is accomplished by selecting the shape of the head (6).

Figure 3B:
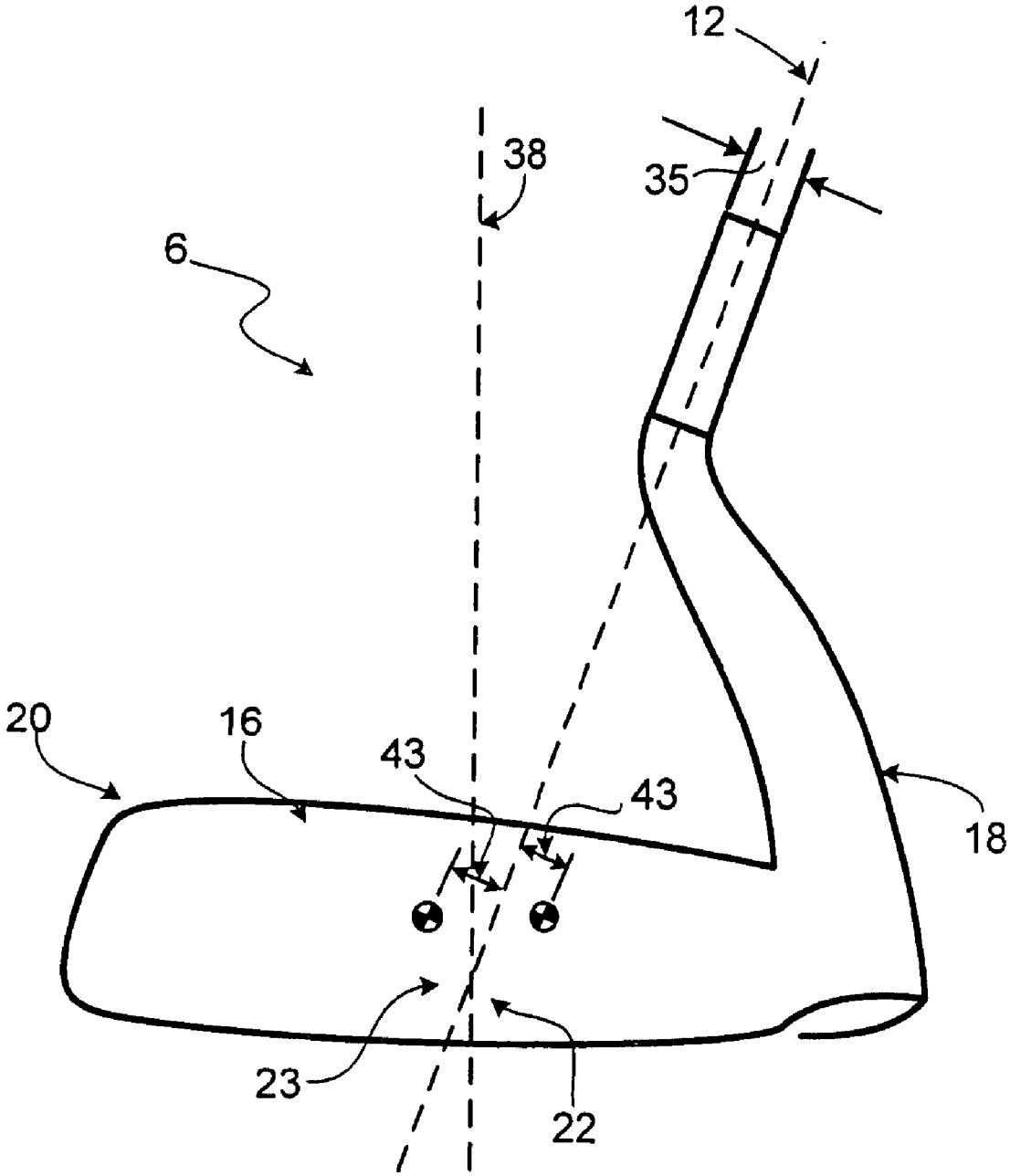
FIG. 3B is a front view of the golf club head of FIG. 1, not to scale.

FIG. 3B is a front view of the head (6) without the shaft. The opening of the hosel (14) is aligned with axis (12). The center of gravity (22) of the head (6) is proximate to the intersection of the axis (12), which extends from the grip region (not shown in this view), plane A (36), and plane B (38). In this embodiment, mass distribution of the head (6) is such that the center of gravity (22) is in front of striking face (16) and is located roughly at the center of the striking face (16). As can be seen in this view, the location of the center of mass (22) of the head (6) is accomplished by balancing the mass of the toe (20) with the mass of the heel (18) such that the center of mass of the head (6) is proximate to the center of the striking face (16). The center of mass may be located within half of the diameter (35) as shown by dimension (43).

Figure 3C:
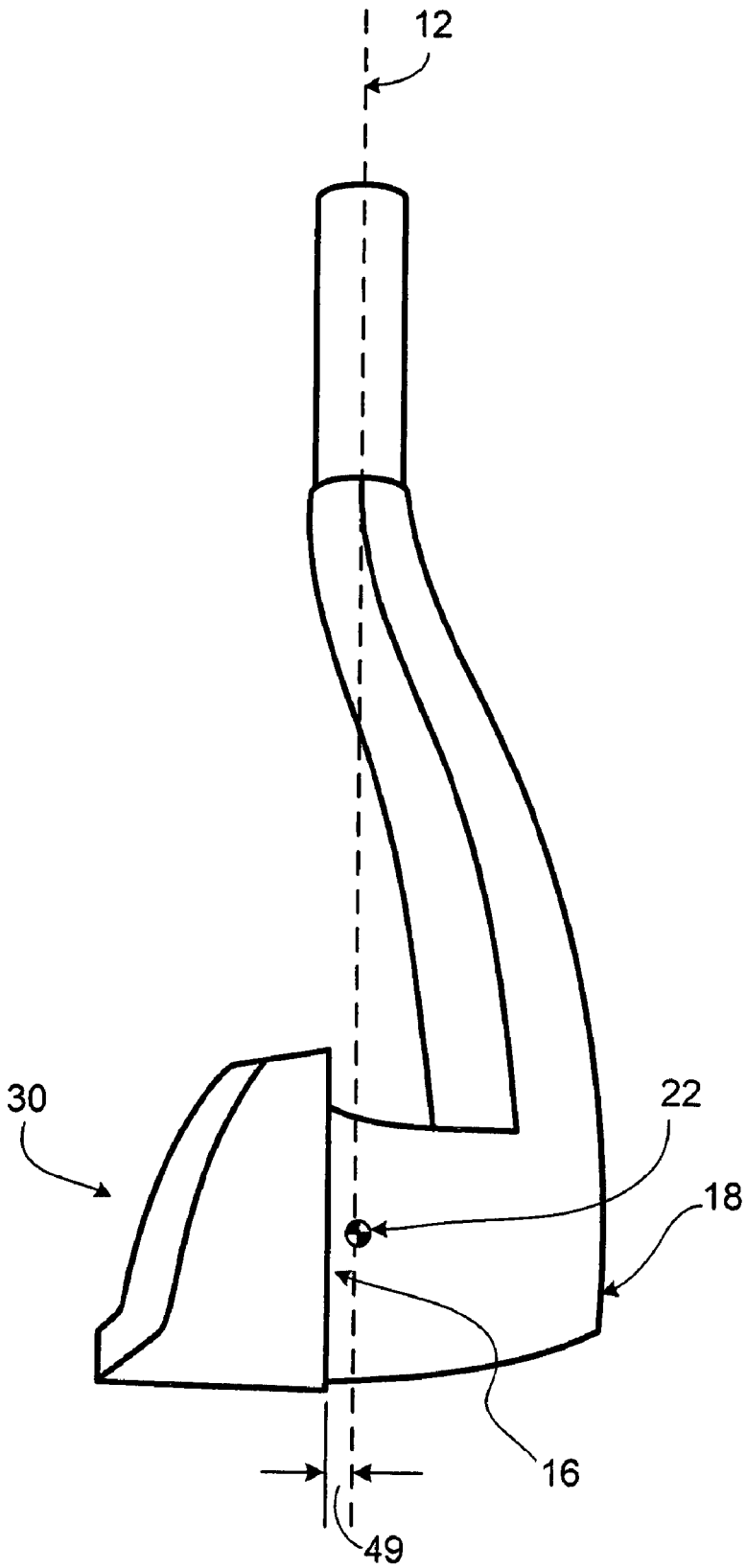
FIG. 3C is a side view from the toe of the golf club head of FIG. 1, not to scale.

FIG. 3C is a side view from the toe side of the head (6) without the shaft. The center of mass (22) of the head (6) The center of mass of the trailing edge (30) is located behind axis (12) (not shown in this view) which lies on plane A (36). In contrast, the center of mass of the heel (18) is located forward of the striking face (16). In the present embodiment, this causes the gravitational center (22) to be located slightly in front of striking face (16) and on axis (12). In some embodiments, it may be advantageous to locate the gravitational center (22) above the sweet spot (23). In other embodiments, it may be advantageous to locate the gravitational center (22) below the sweet spot (23). In other embodiments the gravitational center may be located a distance (49) from the striking face. The distance (49) may be up to 0.84 inch.

Figure 3D:
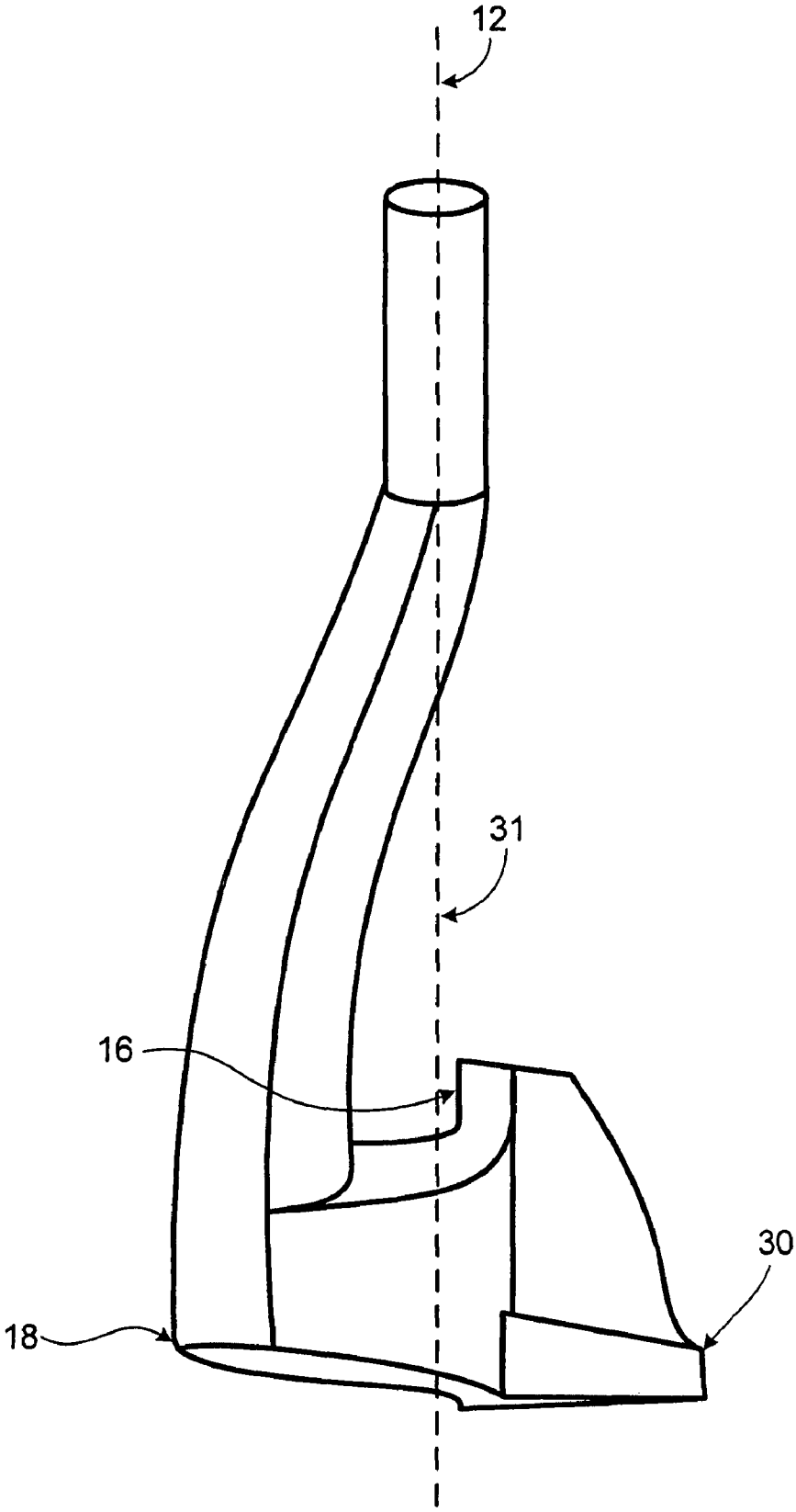
FIG. 3D is a side view from the heel of the golf club head of FIG. 1, not to scale.
Figure 3E:
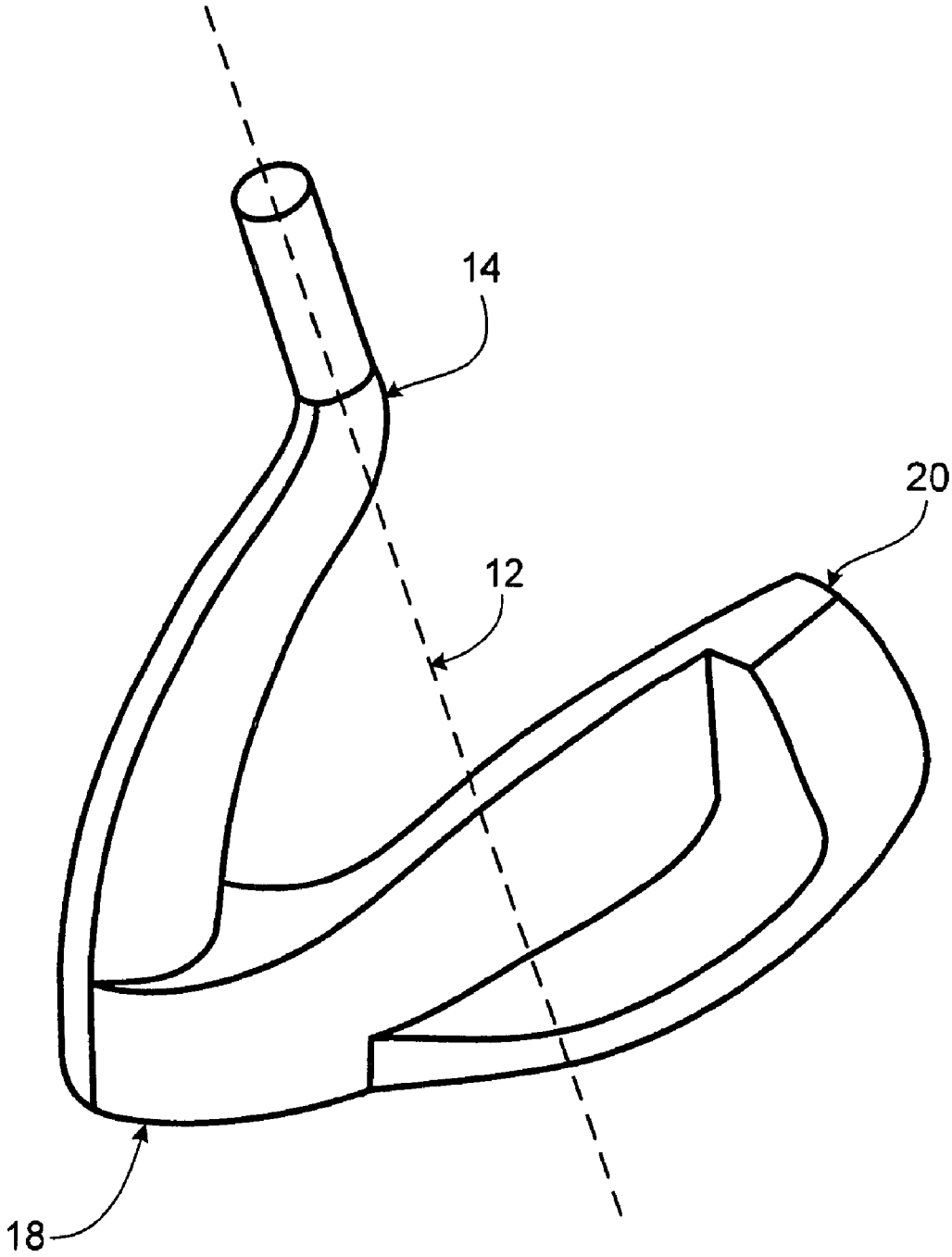
FIG. 3E is an isometric view from the rear of the golf club head of FIG. 1, not to scale.

FIG. 3D is a side view from the heel side of the head (6) without the shaft. In this embodiment, the axis (12) lies a small distance in front of the striking face (16). The center of gravity (not shown in this view) lies on the axis (12) and is a small distance in front of the striking face (16) as shown by gap (31). The mass of the head (6) is shifted in front of the striking face (16) by shifting a majority of the mass of head (6) toward the heel (18) and less of the mass of head (6) toward the trailing edge (30). The gap (31) is preferably less than 0.84 inches forward of the striking face (16). FIG. 3E is an isometric view of the asymmetrical golf club head of FIG. 1. In addition to the forward weight distribution at heel (18), a counterbalance is located at toe (20). The mass of heel (18) and hosel (14) causes the gravitational center (22) to shift forward. It also causes the gravitational center (22) to shift below axis (12). In order to bring the gravitational center (22) back into line with axis (12), a counterbalance is located proximate to toe (20).

Figure 3F:
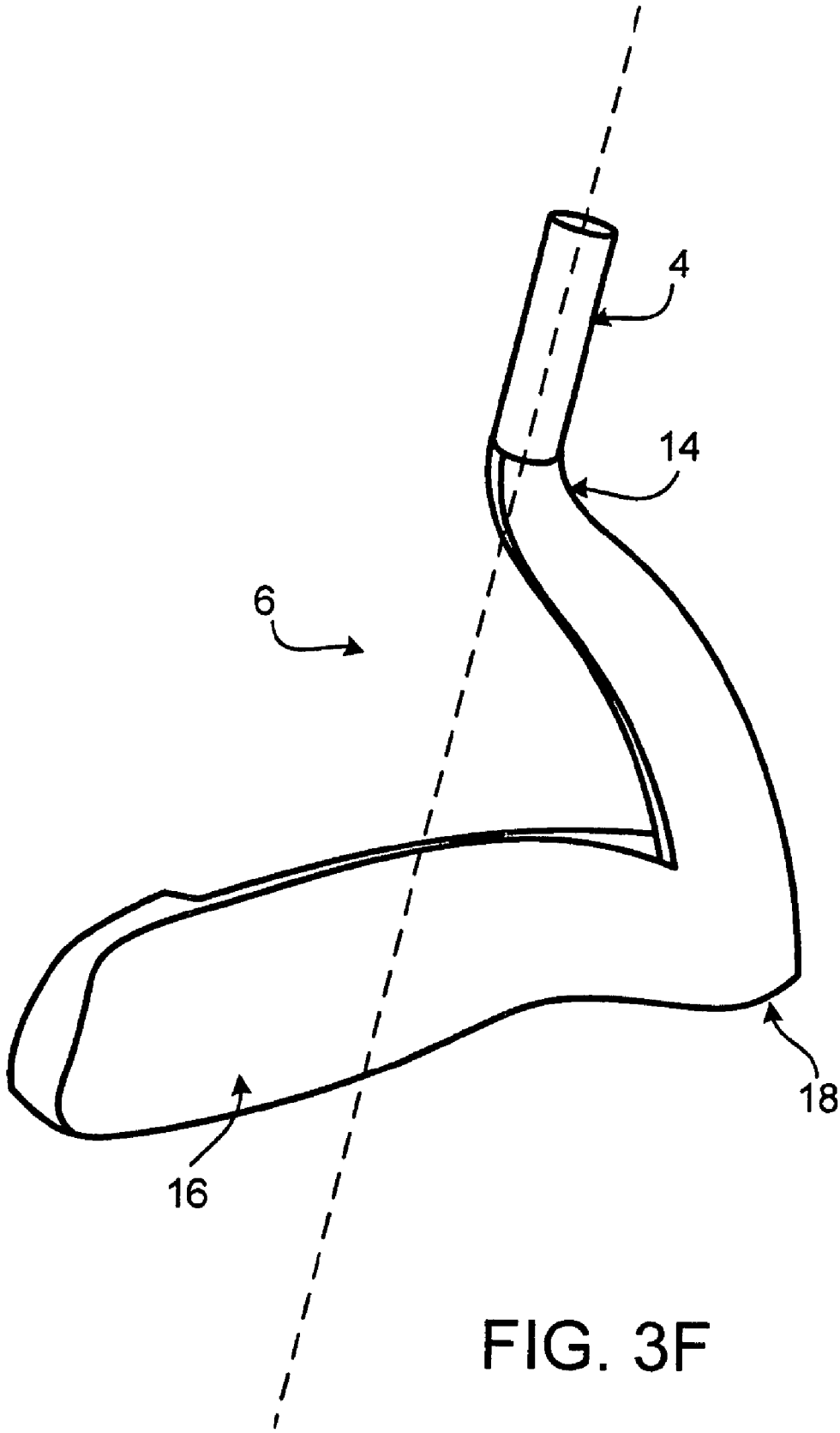
FIG. 3F is an isometric view from the front of the golf club head of FIG. 1, not to scale.

FIG. 3F is an isometric view from the toe side of the head (6) without the shaft. The shaft (4) is secured to hosel (14). At this juncture the heel (18) sweeps forward to shift a portion of the mass of head (6) forward. Then from the heel (18) the head (6) curves back to place the striking face (16) behind the axis (12). This placement allows a player to address a ball in such a manner that the axis (12) lines up with the center of gravity of head (6) and thereby, minimizing the torque caused by head (6).

Figure 4:
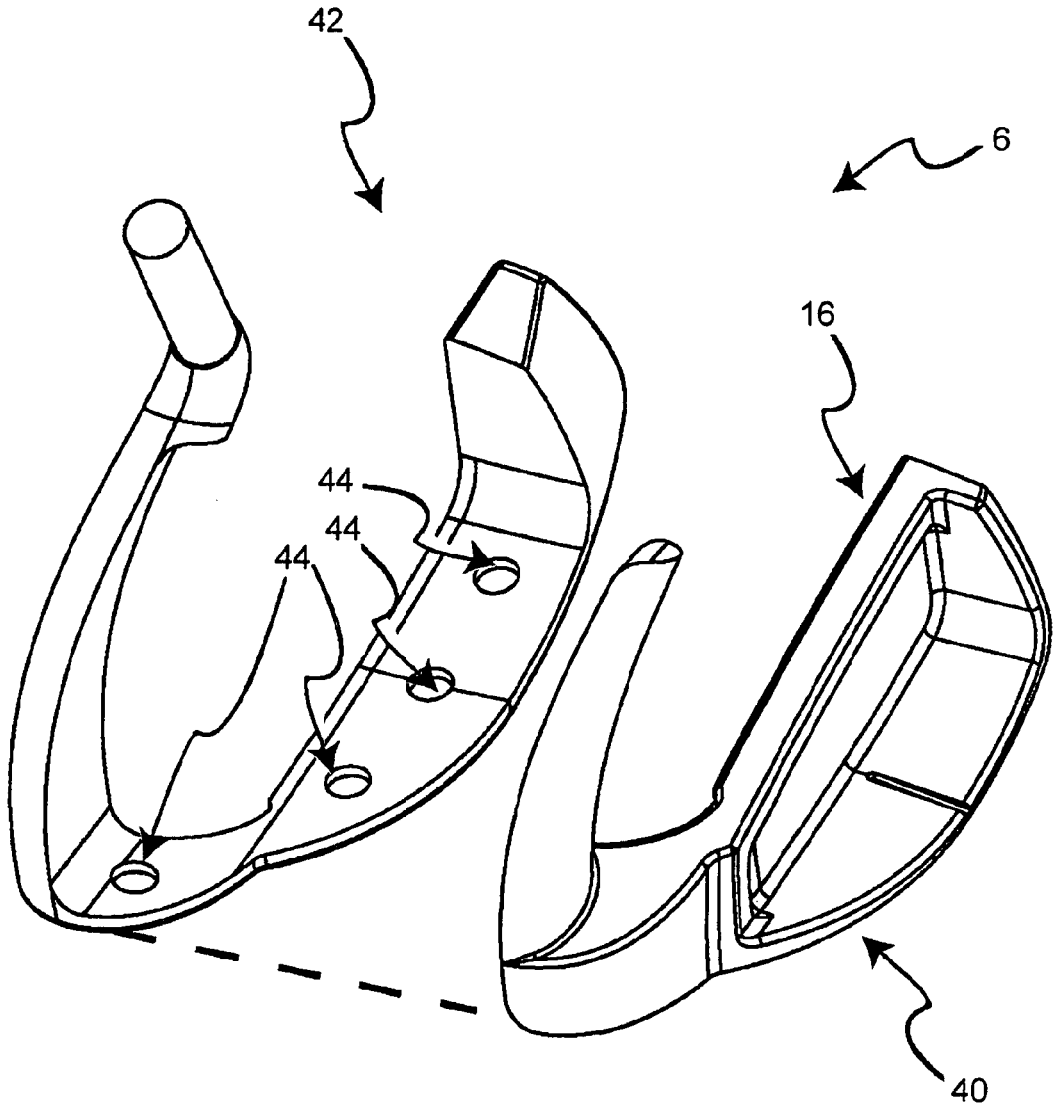
FIG. 4 is another embodiment of a golf club head, not to scale.

FIG. 4 is an exploded view of one embodiment of the head (6) of FIG. 3A. The embodiment shown in FIG. 4 is constructed using two materials of different densities in order to accomplish the proper weight distribution. The placement of the center of gravity (22) in front of the striking face (16) may be accomplished by selecting a lower density material for face (40) then the material selected for base (42). One possible combination is to manufacture face (40) from 6061-T6 Aluminum and to manufacture base (42) from 304 Steel. The location of the center of gravity (22) may be changed by selecting different materials as needed.

Base (42) includes a plurality of openings (44) through which fasteners may be inserted to secure face (40) to base (42). Alternatively, other options include methods such as tongue and groove, insert molding, adhesives, or screwing them together.

In this embodiment, the head (6) is constructed from two parts of different materials. In other embodiments, the head (6) may be constructed from even more parts and materials. For example, face (40), the heel and the toe can be manufactured as three separate steel parts. The proper mass distribution may be accomplished by either varying the densities of the materials selected or varying the densities of the materials selected in combination with the shape of the head and by having interchangeable heel and toe weights.

In other embodiments, removable heel and toe counterweights may be included. The heel and toe counter weights may be removed and replaced by counterweights of different weights in order to make the club lighter or heavier.

Figure 5A:
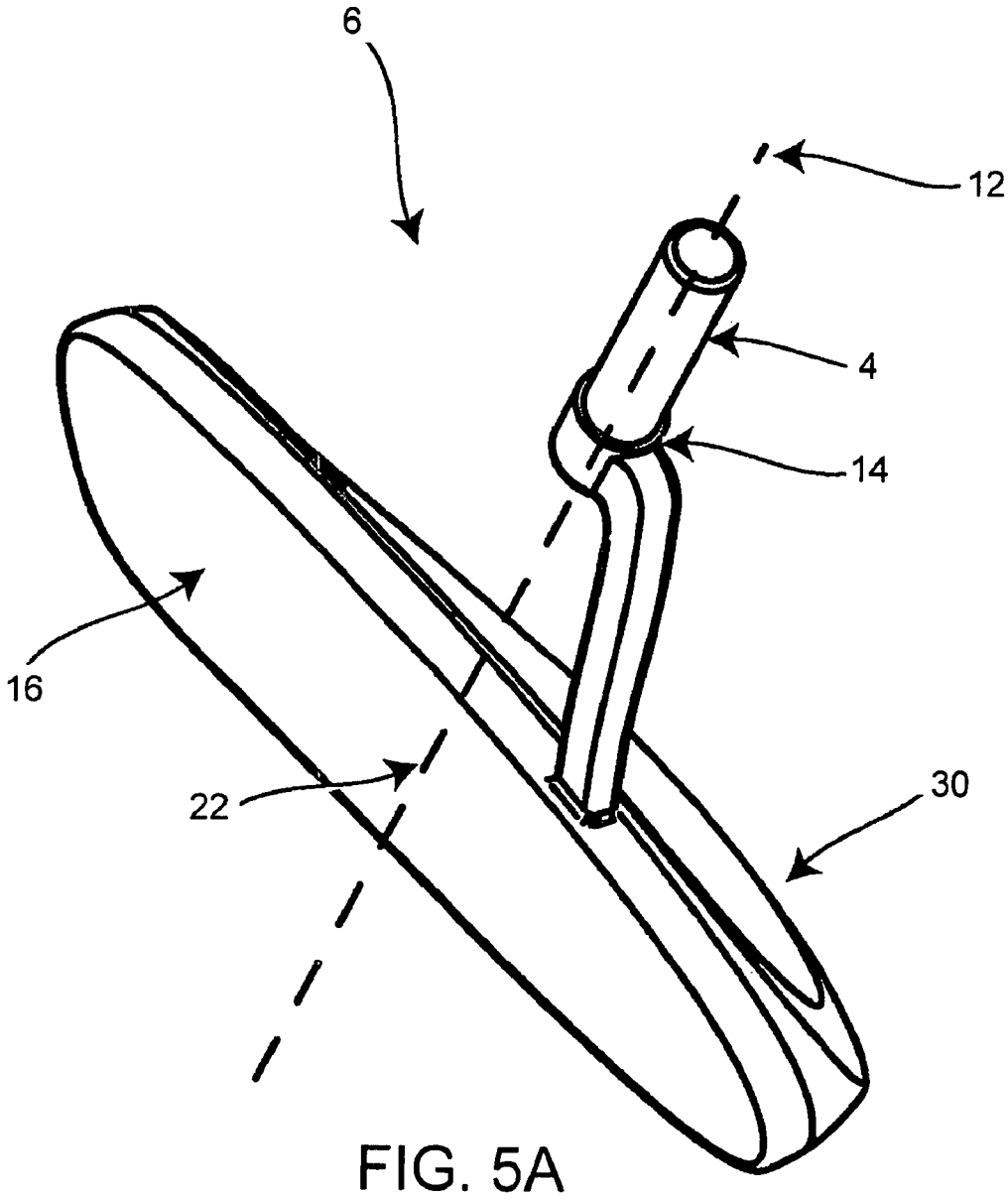
FIG. 5A is a front view of another embodiment of a golf club head, not to scale.

FIG. 5A is a front view of another embodiment of head (6). This embodiment is a more traditional style putter where the axis (12) lies behind striking face (16). The putter head (6) with the center of gravity (22) on the axis (12) and slightly behind the sweet spot (23).

Figure 5B:
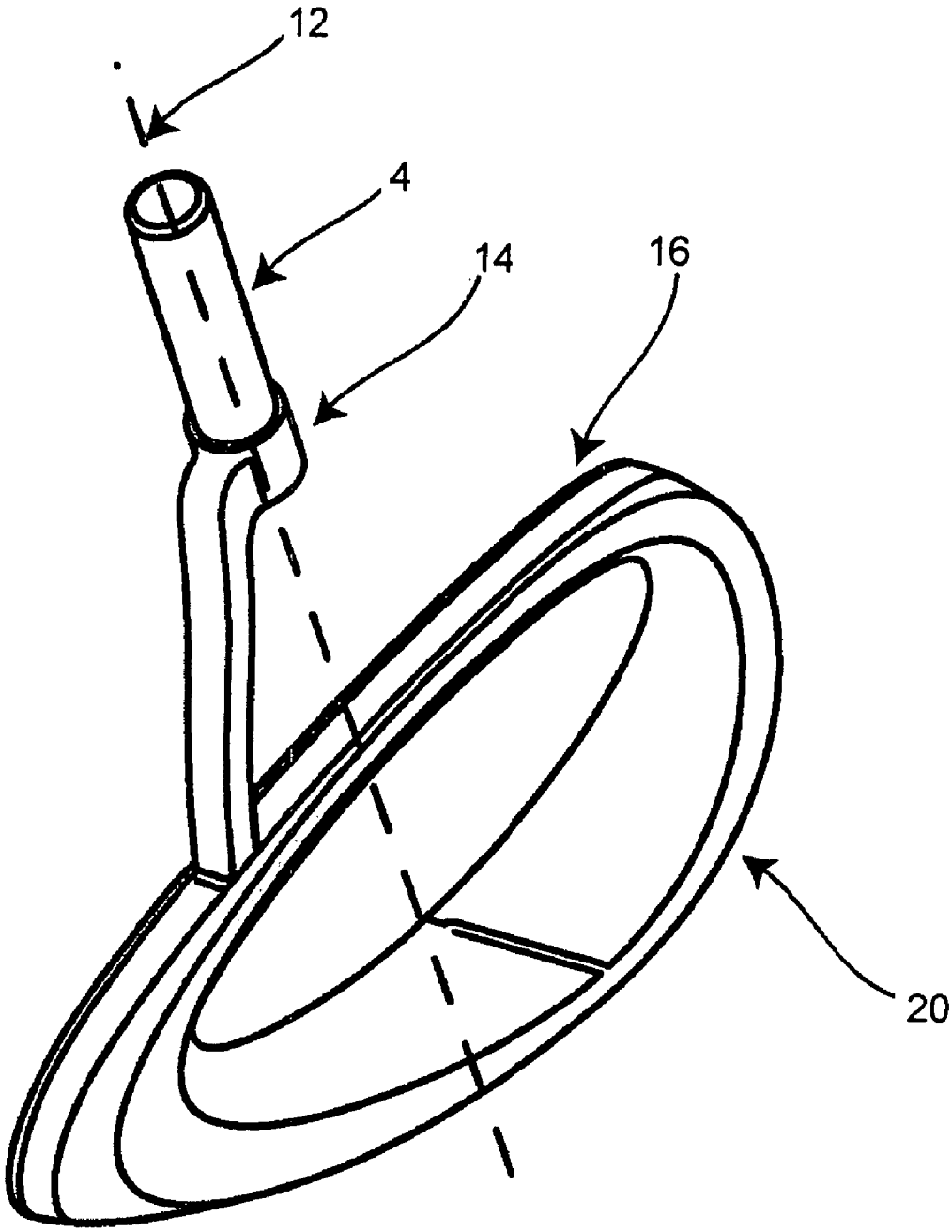
FIG. 5B is a rear view of another embodiment of a golf club head, not to scale.

FIG. 5B is a back view of FIG. 5A. The trailing edge (30) may be constructed from a variety of different shapes. In the embodiment shown, the trailing edge (30) is constructed with a large cavity (31). The lack of material in the area of cavity (31) contributes to the forward shifting of the center of gravity (22). Another technique used to determine the location of the center of gravity (22) on the putter heads is the use of different density materials. Depending on the material selected for striking face (16) and trailing edge (30) the center of gravity (22) may be located either in front of or behind the striking face (16). In either case, the center of gravity (22) should be located on axis (12) or the vertical plane of axis (12). In the embodiment shown, hosel (14) is slightly behind the striking surface so the axis (12) lies slightly behind the striking face (16). The placement of the center of gravity (22) proximate to the striking face (16) is accomplished by selecting a material of significantly higher density for striking face (16) and a material of significantly lower density for trailing edge (30).

Figure 5C:
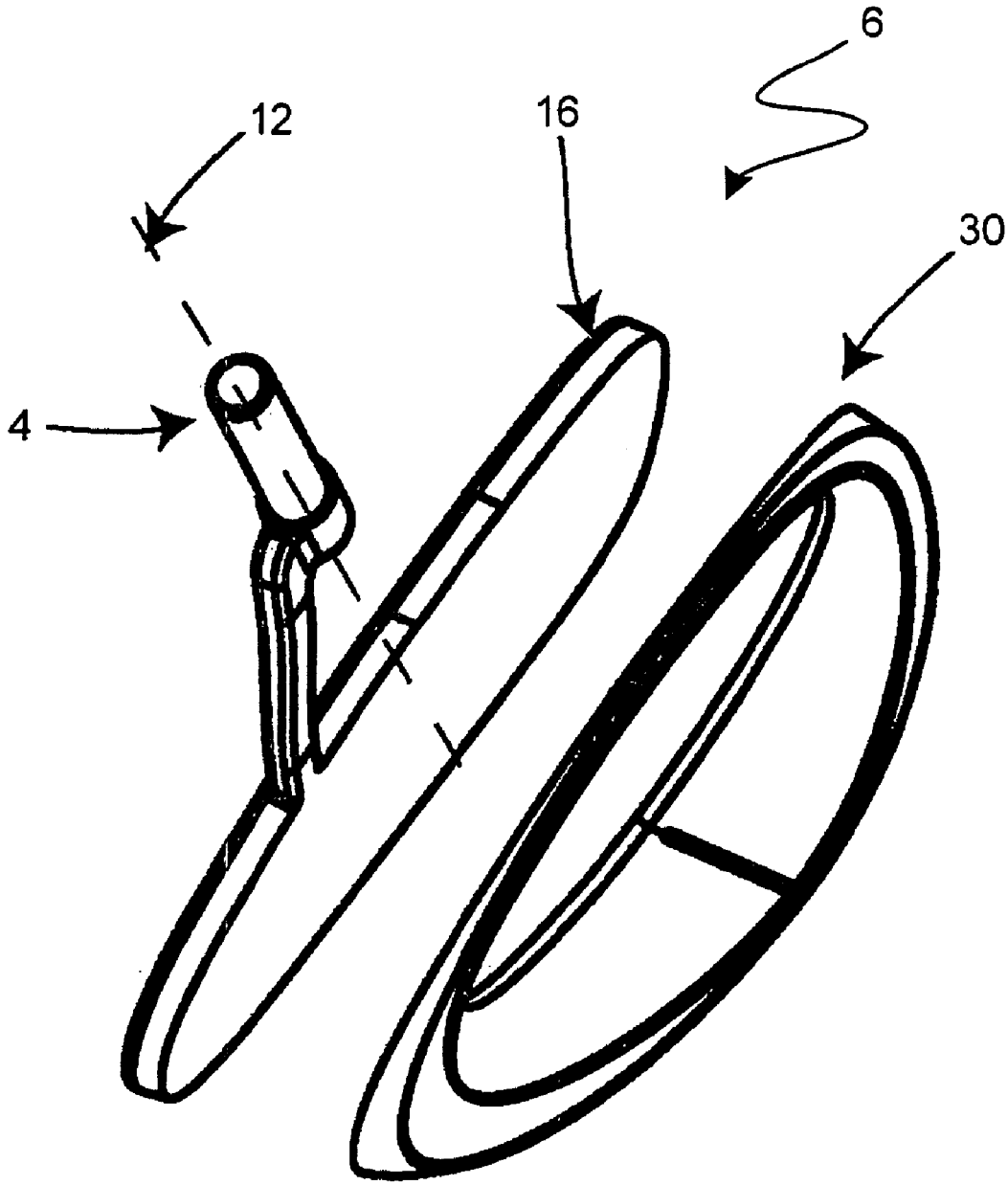
FIG. 5C is an exploded view of another embodiment of a golf club head, not to scale.

FIG. 5C is an exploded view of FIG. 5A. The striking face (16) may be manufactured separately from trailing edge (30). As discussed above this gives the designer the flexibility of choosing the materials for each section. The striking face and the trailing edge may be bonded by using a variety of means known to persons of ordinary skill in the art.

Figure 6:
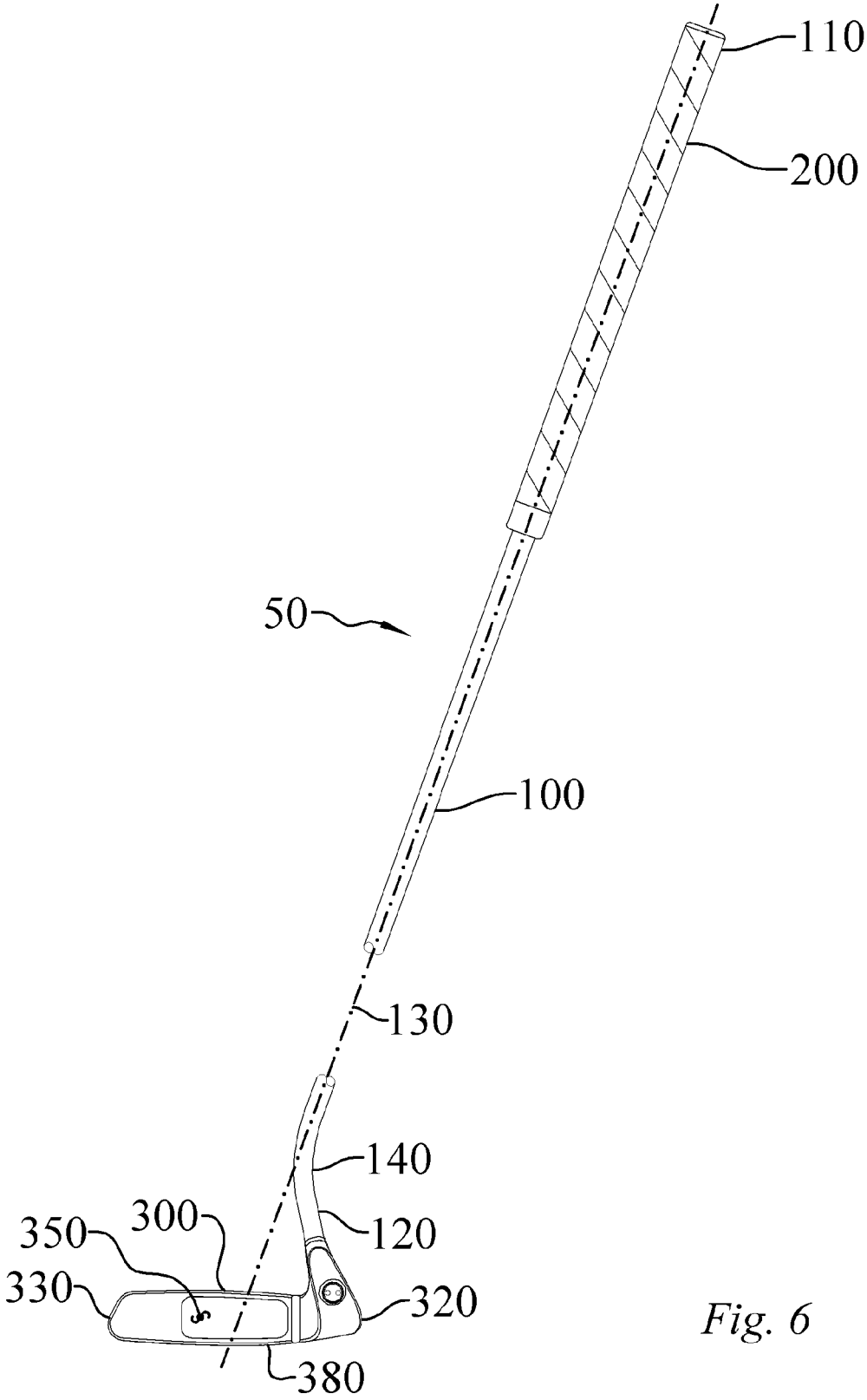
FIG. 6 is a front elevation view of an embodiment of the golf club of the present invention, not to scale.
Figure 7:
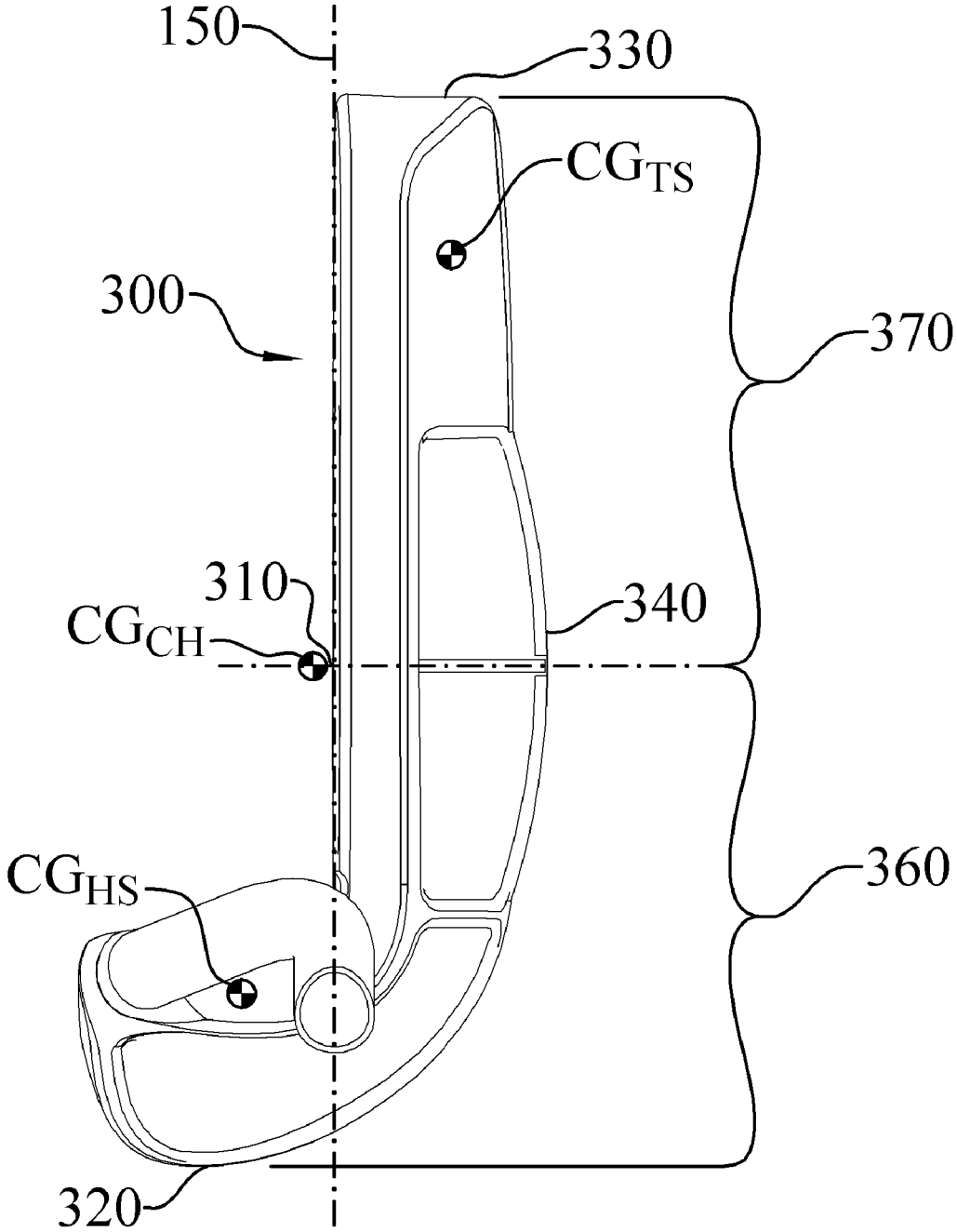
FIG. 7 is a top plan view of an embodiment of the golf club of the present invention, not to scale.
Figure 8:
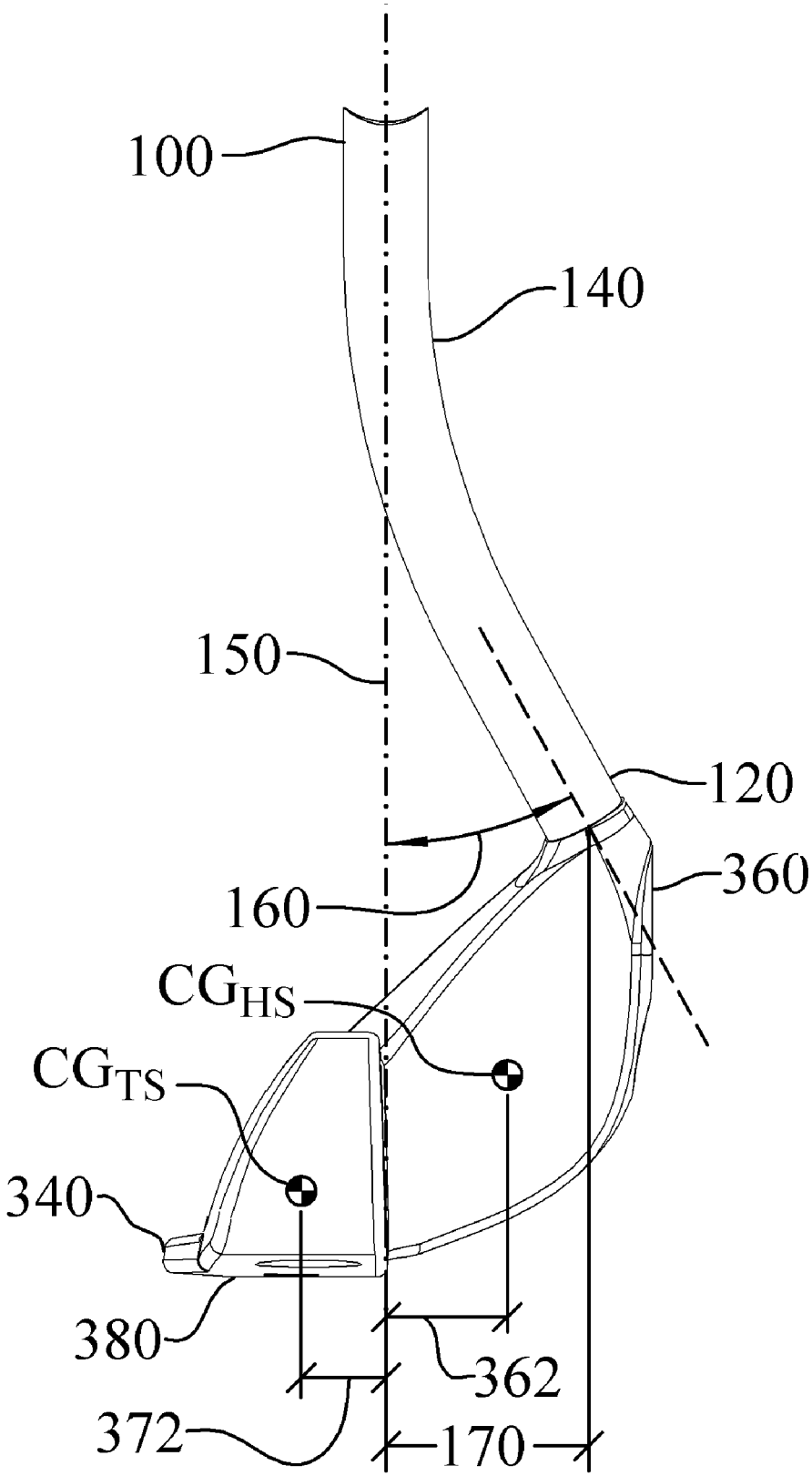
FIG. 8 is a toe side elevation view of an embodiment of the golf club of the present invention, not to scale.

With reference now to FIGS. 6 through 8, still another embodiment of a golf club (50) according to the present invention is illustrated. The golf club (50) includes a shaft (100), a grip (200), and a head (300). Although the drawings depict the golf club (50) as a putter type club, the golf club (50) of the present invention may be a wood or iron type club.

As seen in FIG. 6, the shaft (100) has a shaft proximal end (110), a shaft distal end (120), a shaft axis (130), and a forward bend section (140) proximate the shaft distal end (120). The shaft axis (130) may be defined as an imaginary line extending along the longitudinal center of the shaft (100). Moreover, the shaft axis (130) defines a vertical plane (150) such that the vertical plane (150) includes all points along the shaft axis (130), as seen in FIG. 7.

Still referring to FIG. 6, a grip (200) is secured to the shaft proximal end (110). As previously mentioned, the grip (200)

may comprise a material selected for comfort and control. By way of example, and not limitation, the grip (200) may comprise natural rubber, synthetic rubber, polymers, elastomers, leathers, and combinations thereof.

The head (300) is secured to the shaft distal end (120), as shown in FIG. 6. The head (300) has a club head mass, a club head volume, a sweet spot (310), a club head center of gravity ($CG_{CH}$), a heel (320), a toe (330), a trailing edge (340), a striking face (350), a heel section (360) having a heel section center of gravity ($CG_{HS}$), a toe section (370) having a toe section center of gravity ($CG_{TS}$), and a sole (380), as seen in FIGS. 6 and 7.

As mentioned above, the sweet spot (310) is defined as the location on the striking face (350) that is substantially inline with a substantially perpendicular line extending horizontally from the club head center of gravity ($CG_{CH}$) to the striking face (350). This definition holds true regardless of whether the club head center of gravity ($CG_{CH}$) is located forward of, or behind the striking face (350). In an embodiment where the club head center of gravity ($CG_{CH}$) is located on the striking face (350), the sweet spot (310) will coincide with the club head center of gravity ($CG_{CH}$).

Referring now to FIG. 7, the heel section (360) comprises the portion of the head (300) between the sweet spot (310) and the heel (320). Similarly, the toe section (370) comprises the portion of the head (300) between the sweet spot (310) and the toe (330).

The heel section (360) is designed such that the heel section center of gravity ($CG_{HS}$) is located forward of the striking face (350) by a heel offset distance (362). As seen in FIG. 8, the heel offset distance (362) is the horizontal distance between the leading edge of the striking face (350) and the heel section center of gravity ($CG_{HS}$). The heel offset distance (362) may be between 0.2 inch and 0.84 inch to provide improved feel and roll. The location of the heel section center of gravity ($CG_{HS}$) may be engineered by specifying the heel section (360) geometry (i.e., shape and volume) and/or mass distribution.

In one particular embodiment, a portion of the heel section (360) projects forward of the striking face (350), as seen in FIGS. 7 and 8. In this embodiment, the portion of the heel section (360) that projects forward of the striking face (350) is less than 1.68 inches above the sole (380). This height ensures that the club head center of gravity ($CG_{CH}$) will be lower than the height of a standard golf ball, while still allowing the club head center of gravity ($CG_{CH}$) to be raised higher than conventional blade-type putters for improved roll and feel characteristics.

The toe section (370) is designed such that the toe section center of gravity ($CG_{TS}$) is spaced from the striking face (350) by a toe offset distance (372). As seen in FIG. 8, the toe offset distance (372) is the horizontal distance between the striking face (350) and the toe section center of gravity ($CG_{HS}$). In one particular embodiment, no portion of the toe section (370) extends forward of the striking face (350), and thus the toe section center of gravity ($CG_{HS}$) is positioned behind the striking face (350) by a toe offset distance (372), as seen in FIG. 7. The toe offset distance may be between 0.2 inch and 0.84 inch to provide improved feel and roll by selectively controlling the location of the club head center of gravity ($CG_{CH}$). As with the heel section center of gravity ($CG_{HS}$), the location of the toe section center of gravity ($CG_{TS}$) is a function of the toe section (370) geometry (i.e., shape and volume) and the distribution of mass throughout the toe section (370).

The head (300) is designed such that the club head center of gravity ($CG_{CH}$) is further from the trailing edge (340) than the striking face (350), as illustrated in FIG. 7. Thus, in this embodiment the club head center of gravity ($CG_{CH}$) need not be at or in front of the striking face (350), just simply further from the trailing edge (340) than the striking face (350), as dictated by the locations of the heel section center of gravity ($CG_{HS}$) and the toe section center of gravity ($CG_{TS}$). In the particular embodiment shown in FIG. 7, the club head center of gravity ($CG_{CH}$) is slightly forward of the striking face (350). However, in other embodiments the club head center of gravity ($CG_{CH}$) may be on the striking face (350) or behind the striking face (350). It should be noted that the club head center of gravity ($CG_{CH}$) need not align with the geometric center of the striking face (350). The particular location of the club head center of gravity ($CG_{CH}$) will depend on the locations of the heel section center of gravity ($CG_{HS}$) and the toe section center of gravity ($CG_{TS}$), which in turn depend on the geometry (i.e., shape and volume) and mass distribution of the heel section (360) and the toe section (370).

In another embodiment, the head (300) may be designed such that the heel offset distance (362) and the toe offset distance (372) are at least twice as far from the striking face (350) as the club head center of gravity ($CG_{CH}$). Such an embodiment results in the club head center of gravity ($CG_{CH}$) being located near or on the striking face (350), which provides the golf club (50) with a preferred balance and feel for some golfers.

As seen in FIG. 8, the shaft (100) includes a forward bend section (140) proximate the shaft distal end (120). The forward bend section (140) projects from the vertical plane (150) at an attachment angle (160). The attachment angle (160) is designed such that the shaft distal end (120) is attached to a portion of the heel section (360) that is forward of the heel section center of gravity ($CG_{HS}$), which along with the fact that the heel section center of gravity ($CG_{HS}$) is forward of the striking face (350) provides a feel like no other golf club.

Still referring to FIG. 8, the forward bend section (140) results in the shaft distal end (120) being positioned forward of the vertical plane (150) by an attachment distance (170). The attachment distance (170) is the horizontal distance measured from the vertical plane (150) to the longitudinal center of the shaft (100) at the point of attachment between the shaft distal end (120) and the heel section (360). In one embodiment, the shaft (100) and head (300) may be designed such that the attachment distance (170) is at least twice the heel offset distance (362).

The forward bend section (140) creates a pleasing aesthetic appearance that corresponds to a more traditional golf club (50) design. For example, a golfer using a golf club (50) with a traditional design is accustomed to seeing the shiny, chrome-plated shaft (100) when addressing a golf ball. With the non-traditional design of the golf club (50) of the present invention, the forward bend section (140) covers up a portion of the non-traditional heel section (360) and allows the golfer to view a portion of the familiar shiny, chrome-plated shaft (100). As illustrated in FIG. 8, the attachment angle (160) is the angle at which the forward bend section (140) projects from the vertical plane (150). Thus, one embodiment has identified that having the attachment angle (160) be at least 15 degrees provides a preferred degree of visual shielding of the heel section (360) that is forward of the striking face (350). Furthermore, the forward bend section (140) allows for the shaft axis (130) to be substantially aligned with the striking face (350), thus providing a player with the visual comfort that they are familiar with while providing the unique beneficial performance and balance of the present invention.

The location and positioning of the club head center of gravity ($CG_{CH}$) contributes to the balance and the feel of the golf club (50). Thus, some golfers may prefer the feel of a golf club (50) where the club head center of gravity ($CG_{CH}$) is forward of the striking face (350), while other golfers may prefer the feel of a golf club (50) where the club head center of gravity ($CG_{CH}$) is at or behind the striking face (350). Likewise some golfers prefer the club head center of gravity ($CG_{CH}$) located more toward the heel (320), while others prefer the club head center of gravity ($CG_{CH}$) located more toward the toe (330). Regardless of the exact placement of the club head center of gravity ($CG_{CH}$), the present invention's unique heel section center of gravity ($CG_{HS}$) along with the shaft's forward bend section (140) provide a balance and performance unlike conventional golf clubs. Further, since some golfers may prefer a golf club (50) having the shaft axis (130), and hence the vertical plane (150), at or forward of the striking face (350), while other golfers may prefer a golf club (50) having the shaft axis (130), and hence the vertical plane (150), positioned behind the striking face (350); the present invention's forward bend section (140) allows for such flexibility while still having the shaft distal end (120) connect to the head (300) at a point forward of the heel section center of gravity ($CG_{HS}$), and all the feel, balance, and roll benefits afforded from such a connection location.

In order to accommodate the preferences of any golfer, the golf club (50) of the present invention may be designed with a customized location of the club head center of gravity ($CG_{CH}$). For example, in one embodiment, the club head center of gravity ($CG_{CH}$) may be spaced less than about 0.65 inch from the vertical plane (150), while having the heel section center of gravity ($CG_{HS}$) in front of the striking face (350) and the toe section center of gravity ($CG_{TS}$) behind the striking face (350). Even further, another embodiment incorporates the club head center of gravity ($CG_{CH}$) disposed less than about 0.84 inch forward of the striking face (350) for even more desirable performance. In still another embodiment, the club head center of gravity ($CG_{CH}$) may be disposed substantially on the vertical plane (150); and yet another embodiment goes even further in having the club head center of gravity ($CG_{CH}$) disposed on the shaft axis (130).

As previously mentioned, the location of the club head center of gravity ($CG_{CH}$) is a function of the locations of the heel section center of gravity ($CG_{HS}$) and the toe section center of gravity ($CG_{TS}$), which in turn depend on the geometry (i.e., shape and volume) and mass distribution of the heel section (360) and the toe section (370). Thus, the location of the club head center of gravity ($CG_{CH}$) is carefully engineered by designing the heel section (360), the toe section (370), or both to have specific shapes, volumes, and mass distributions.

For example, in one embodiment the heel section (360) is designed such that a portion of the heel section (360) projects forward of the striking face (350) and the forward portion has a volume that is at least 20 percent of the club head volume. This large volume forward portion plays a significant role in locating the heel section center of gravity ($CG_{HS}$), which in turn influences the club head center of gravity ($CG_{CH}$). The head (300) may comprise a single material or multiple materials having different densities. Having at least 20 percent of the club head volume forward of the striking face (350) will tend to move the club head center of gravity ($CG_{CH}$) further from the trailing edge (340) and closer to the striking face (350).

In yet another embodiment, the head (300) is designed such that a portion of the heel section (360) projects forward of the striking face (350) and the percentage of the club head mass of the portion of the heel section (360) that projects forward of the striking face (350) is greater than the percentage of the club head volume of the portion of the heel section (360) that projects forward of the striking face (350). For example, the portion of the heel section (360) that projects forward of the striking face (350) may comprise 50 percent of the club head mass and 15 percent of the club head volume. This may be accomplished by constructing the heel section (360) and the toe section (370) with higher and lower density materials, respectively. Additionally, this particular embodiment may be accomplished by utilizing removable heel (320) and toe (330) weights comprised of high or low density materials, as discussed above.

A number of embodiments of the invention have been described. Nevertheless, it will be understood that various modifications may be made without departing from the spirit and scope of the invention. For example, the club head center of gravity can be located in front of the striking face and on the shaft axis of a one-piece head by changing the shape so that a majority of the material mass is located in front of the forward face. It must be noted that for descriptive purposes, the mass distribution of head above was described using a 2-dimensional frame of reference. It is understood that the mass of head is distributed throughout the head and not focused at points such as the toe and heel. Given this fact, one of ordinary skill in the art will understand that many different and complex shapes can be created within the scope of the claims. Accordingly, other embodiments are within the scope of the following claims.

I claim:

1. A golf club comprising:

a shaft having a shaft proximal end, a shaft distal end, a shaft axis, and a forward bend section proximate the shaft distal end, the shaft axis defining a vertical plane;

a grip secured to the shaft proximal end;

a head secured to the shaft distal end, the head having a club head mass, a club head volume, a sweet spot, a club head center of gravity, a heel, a toe, a trailing edge, a striking face, a heel section having a heel section center of gravity, a toe section having a toe section center of gravity, and a sole; and wherein:

(i) the heel section comprises the portion of the head from a heel end to the sweet spot such that the heel section center of gravity is forward of the striking face by a heel offset distance;

(ii) the club head center of gravity is further from the trailing edge than the striking face; and (iii) the forward bend section projects from the vertical plane at an attachment angle and the shaft distal end is forward of the heel section center of gravity.

2. The golf club of claim 1, wherein the golf club is a putter.

3. The golf club of claim 1, wherein a portion of the heel section projects forward of the striking face and has a volume that is at least 20 percent of the club head volume.

4. The golf club of claim 1, wherein the club head center of gravity is spaced less than about 0.65 inch from the vertical plane.

5. The golf club of claim 1, wherein the club head center of gravity is disposed substantially on the vertical plane.

6. The golf club of claim 1, wherein no portion of the toe section extends forward of the striking face.

7. The golf club of claim 1, wherein the club head center of gravity coincides with the sweet spot.

8. The golf club of claim 1, wherein the shaft axis is at, or forward of, the striking face.

9. The golf club of claim 1, wherein the club head center of gravity is forward of the striking face.

10. The golf club of claim 9, wherein the club head center of gravity is disposed less than about 0.84 inch forward of the striking face.

11. The golf club of claim 1, wherein the shaft distal end is forward of the vertical plane by an attachment distance and the attachment distance is at least twice the heel offset distance.

12. The golf club of claim 1, wherein the toe section center of gravity is behind the striking face by a toe offset distance.

13. The golf club of claim 12, wherein the heel offset distance and the toe offset distance are at least twice as far from the striking face as the club head center of gravity.

14. The golf club of claim 1, wherein a portion of the heel section projects forward of the striking face and the percentage of the club head mass of the portion of the heel section that projects forward of the striking face is greater than the percentage of the club head volume of the portion of the heel section that projects forward of the striking face.

15. The golf club of claim 1, wherein a portion of the heel section projects forward of the striking face and a majority of the portion of the heel section that projects forward of the striking face is less than 1.68 inches above the sole.

16. A golf club comprising:

a shaft having a shaft proximal end, a shaft distal end, a shaft axis, and a forward bend section proximate the shaft distal end, the shaft axis defining a vertical plane;

a grip secured to the shaft proximal end;

a head secured to the shaft distal end, the head having a club head mass, a club head volume, a sweet spot, a club head center of gravity, a heel, a toe, a trailing edge, a striking face, a heel section having a heel section center of gravity, a toe section having a toe section center of gravity, and a sole; and wherein:

(i) the heel section comprises the portion of the head from a heel end to the sweet spot such that the heel section center of gravity is forward of the striking face by a heel offset distance;

(ii) a portion of the heel section projects forward of the striking face and has a volume that is at least 20 percent of the club head volume (iii) the club head center of gravity is further from the trailing edge than the striking face; and (iv) the forward bend section projects from the vertical plane at an attachment angle and the shaft distal end is forward of the heel section center of gravity.

17. The golf club of claim 16, wherein the club head center of gravity is spaced less than about 0.65 inch from the vertical plane.

18. The golf club of claim 16, wherein no portion of the toe section extends forward of the striking face.

19. A golf club comprising:

a shaft having a shaft proximal end, a shaft distal end, a shaft axis, and a forward bend section proximate the shaft distal end, the shaft axis defining a vertical plane;

a grip secured to the shaft proximal end;

a head secured to the shaft distal end, the head having a club head mass, a club head volume, a sweet spot, a club head center of gravity, a heel, a toe, a trailing edge, a striking face, a heel section having a heel section center of gravity, a toe section having a toe section center of gravity, and a sole; and wherein:

(i) the heel section comprises the portion of the head from a heel end to the sweet spot such that the heel section center of gravity is forward of the striking face by a heel offset distance;

(ii) no portion of the toe section extends forward of the striking face such that the toe section center of gravity is behind the striking face by a toe offset distance;

(iii) the heel offset distance and the toe offset distance are at least twice as far from the striking face as the club head center of gravity;

(iv) the club head center of gravity is further from the trailing edge than the striking face;

(v) the forward bend section projects from the vertical plane at an attachment angle and the shaft distal end is forward of the heel section center of gravity; and (vi) a portion of the heel section projects forward of the striking face and a majority of the portion of the heel section that projects forward of the striking face is less than 1.68 inches above the sole.

* * * * *